United States Patent [19]

DiMarco

[11] 4,095,075

[45] June 13, 1978

[54] VISIBLE BLADE SWITCH

[75] Inventor: Bernard DiMarco, Bellefontaine, Ohio

[73] Assignee: Gould Inc., Rolling Meadows, Ill.

[21] Appl. No.: 681,253

[22] Filed: Apr. 28, 1976

[51] Int. Cl.[2] ..... H01H 9/16

[52] U.S. Cl. ..... 200/308

[58] Field of Search ..... 200/308; 335/17; 116/124 L

[56] References Cited

U.S. PATENT DOCUMENTS

| | | | |
|---|---|---|---|
| 2,665,344 | 1/1954 | Zozulin et al. | 200/308 X |
| 2,685,011 | 7/1954 | Boller et al. | 200/308 X |
| 2,854,555 | 9/1958 | Edmunds | 200/308 |

*Primary Examiner*—J. V. Truhe
*Assistant Examiner*—D. A. Tone
*Attorney, Agent, or Firm*—Ostrolenk, Faber, Gerb & Soffen

[57] ABSTRACT

An electrical switch is provided with a pivotable contact arm so constructed and positioned that when the switch is open an indicating portion of the arm is viewable from the front of the switch, and when the switch is closed the indicating portion is retracted from view. This indicating portion of the arm is located on a forwardly stepped portion of the arm and is disposed at the end of the arm remote from the separable contact region.

8 Claims, 4 Drawing Figures

VISIBLE BLADE SWITCH

This invention relates to electrical switches in general and more particularly relates to means for indicating that the switch contacts are in the open position.

As uses of higher voltages increase or as available circuit currents increase, it becomes increasingly hazardous to service electrical switches that are closed. It is especially dangerous to service electrical switches that are believed to be open but because of some operational defect have closed contacts.

The prior art has attempted to cope with this type of hazard by providing so-called visible blade switches which permit direct viewing of the movable switch contacts to determine whether they have separated from the stationary contacts. For the most part the prior art solution has been to provide a hole in the cover of the switch housing to permit viewing of the chamber where the contacts separate and arc currents are extinguished. If this hole is uncovered, interruption may be adversely effected. If a removable cover is provided for the hole, substantial added expense is involved and if a clear plastic window is provided for the hole, such window usually becomes opaque after repeated current interruptions.

Other prior art solutions require the addition of one or more elements. An example of this latter type is found in the W. H. Edmunds U.S. Pat. No. 2,854,555 which discloses an indicating means for multi-pole circuit breakers. In such patent the movable contact arm physically moves a separate indicating member when the contact arm is in its open position.

In order to overcome difficulties attendant with utilization of prior art teachings for positively indicating that switch contacts are open and without adversely effecting interrupting properties of the switch, the instant invention provides a pivoted arm having the movable switch contact at one end and an indicator at the other end. The indicator is so positioned that as the arm pivots between the open and closed positions of the switch, the indicator may be viewed directly when the switch is open. However, when the switch is closed, the indicator is in a retracted position so as not to be viewable, thereby providing a positive indication that the switch contacts are closed.

Accordingly, a primary object of the instant invention is to provide an electrical switch having novel means for positively indicating that the switch is open.

Another object is to provide a switch of this type in which the indicating means is at the end of the contact arm remote from the movable contact and is positioned so as to be viewable from outside of the switch housing when the switch is open.

Still another object is to provide a switch having an indicating means constructed so that no additional parts are required and the interrupting properties of the switch are not adversely effected.

A further object is to provide an indicating means of this type that does not require opening of the switch housing for viewing of the indicating means.

A still further object is to provide an indicating means that is directly viewed rather than one which requires a transparent cover.

These objects as well as other objects of this invention shall become readily apparent after reading the following description of the accompanying drawings in which:

FIG. 1 is a plan view of a unitized combination motor starter including trip bar means constructed in accordance with teachings of the instant invention.

Figure 4:
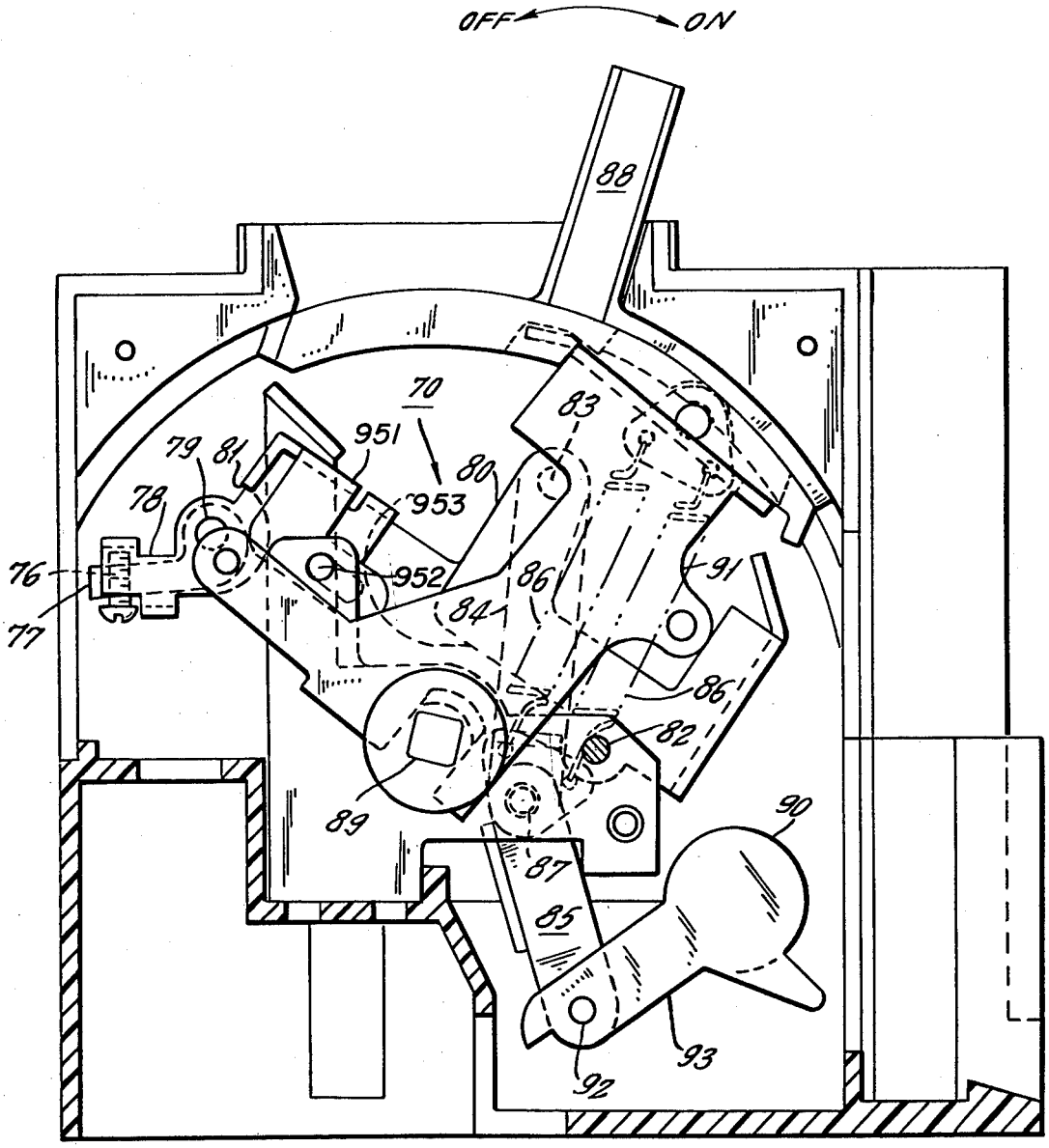
FIG. 4 is a cross-section taken through line 4—4 of FIG. 1 looking in the direction of arrows 4—4 and showing the elements of the circuit breaker manual operating mechanism in contact closed position.

Now referring to the FIGS. Unitized combination motor starter 20 includes a molded insulating housing consisting of base 21 and removable shallow front cover 22 secured in operative position by screws 19. Cover 22 includes longitudinally extending parallel ribs that mate with similar ribs 24, 25, 26 in base 21 to form elongated parallel compartments. Three of these compartments have current carrying elements identical to those illustrated in the right hand portion of FIG. 2, and constitute a pole of the three pole circuit breaker portion 59 of starter 20. Removable side cover 67 is provided for the compartment which encloses spring powered trip free contact operating mechanism 70 of FIG. 4.

Figure 7:
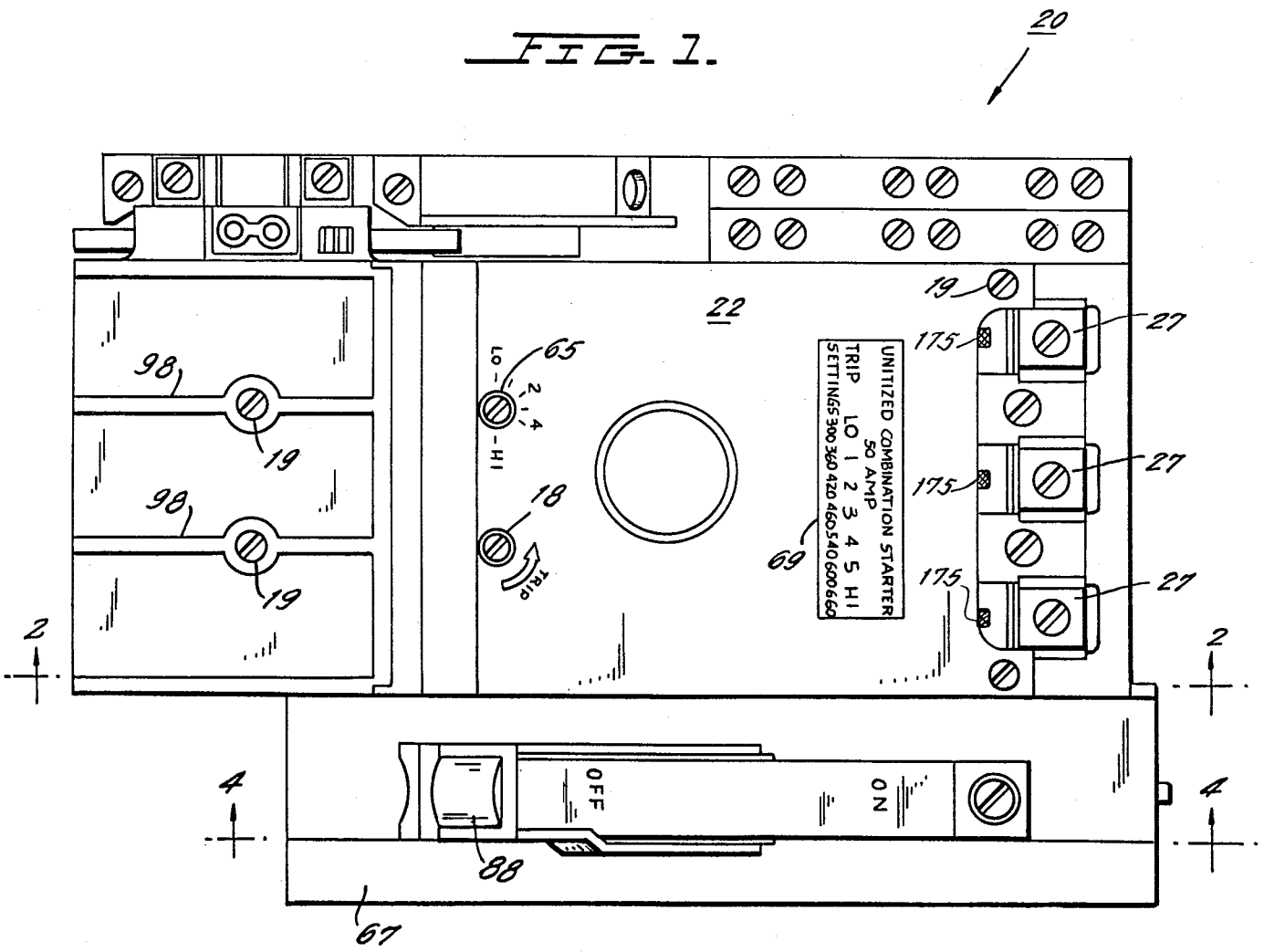
Figure 2:
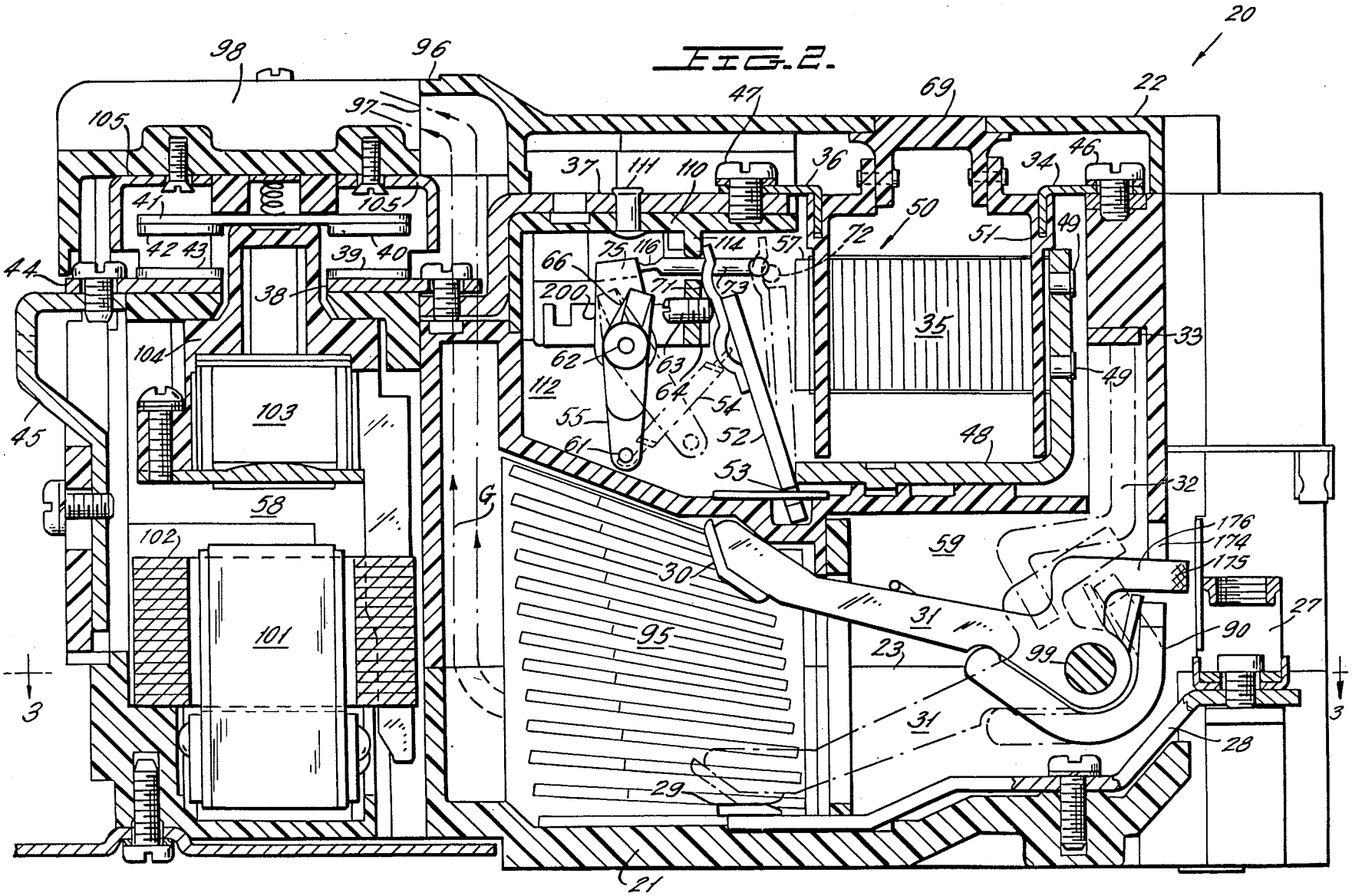
FIG. 2 is a cross-section taken through line 2—2 of FIG. 1 looking in the direction of arrows 2—2 and showing the elements of one pole unit.
Figure 3:
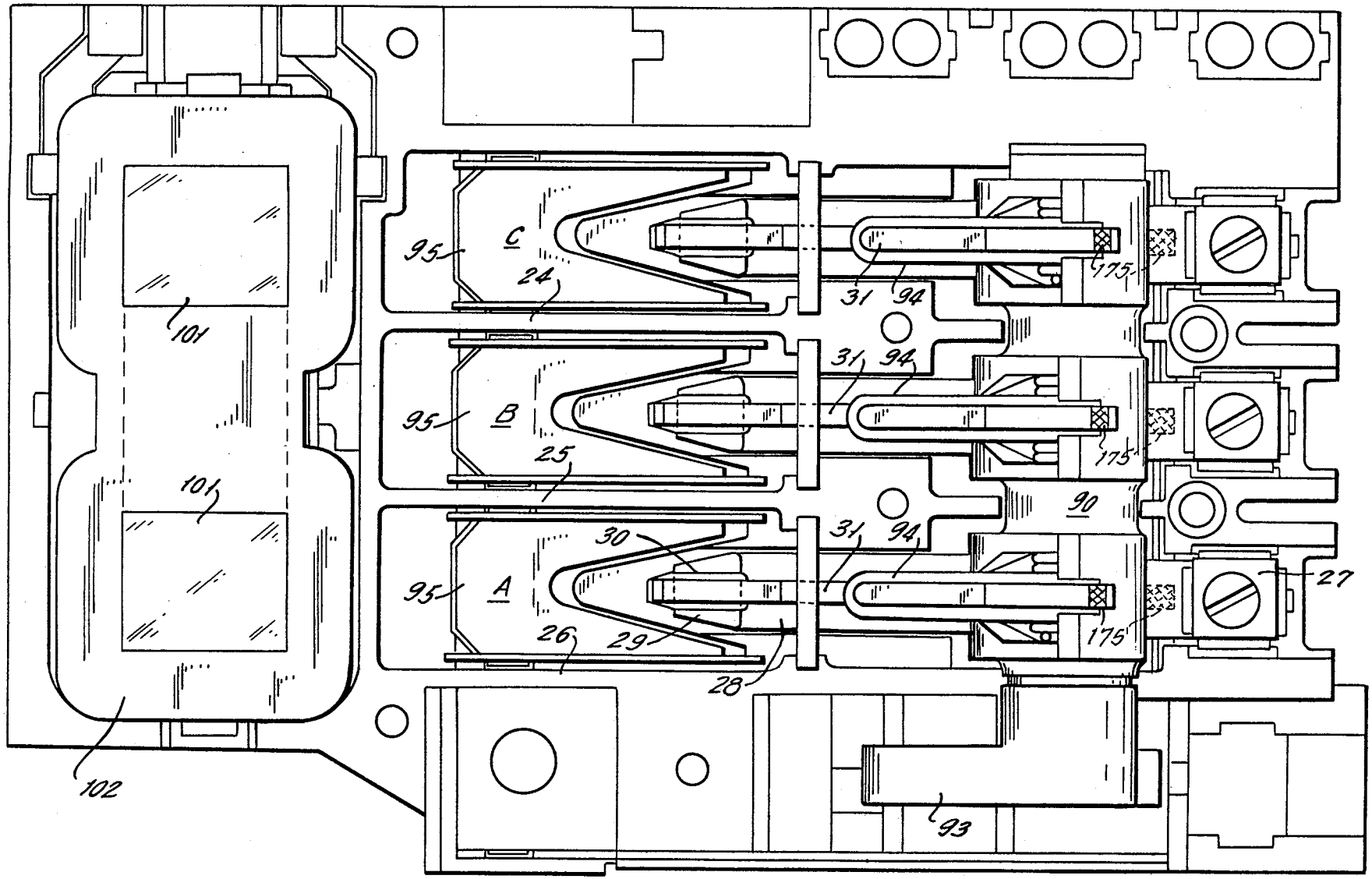
FIG. 3 is a cross-section taken through lines 3—3 of FIG. 2 with the circuit breaker contacts closed, looking in the direction of arrows 3—3.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of movable contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Coil 35 is part of circuit breaker calibrating assembly 50 removable and replaceable from the front of starter 20 after front cover 22 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnetic frame 48. The latter is secured by rivets 49, 49 to insulator 51 having terminal 34 and bobbin 57 mounted thereto. The magnetic frame also includes movable armature 52 which is pivotally mounted at its lower end in the region indicated by reference numeral 53 so that the upper end of armature 52 may move toward and away from stationary frame portion 48. Coiled tension spring 54 is connected to pin formation 61 at the edge of radial adjusting bar 55 remote from its pivot provided by pins 62. Thus, spring 54 biases the forward end of armature 52 away from magnetic frame 48.

The air gap adjustment between armature 52 and frame 48 is set by screw 63 which is threadably mounted to transverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within an aperture of auxiliary cover 110. Turn-to-trip control 18 also extends through and is journalled for movement within an aperture of auxiliary cover 110. Both controls 65 and 18 are accessible for operation through apertures in main cover 22.

Upon the occurrence of predetermined fault current conditions the flux generated by current flowing in coil 35 attracts armature 52 to stationary frame 48 causing bifurcated armature bracket 71 to engage enlarged formation 72 on transverse extension 73 of common tripper bar 75. The latter is part of tripper bar means 200 that pivots clockwise about an axis which coincides with axis 62 for adjusting bar 55 which causes screw 76 on tripper bar extension 77 to pivot latch member 78 in a clockwise or tripping direction about its pivot 79, thereby releasing latching point 81 of latch plate 951 on pivot 952 thereby releasing latching point 953 of cradle 80 so that the latter is free to pivot clockwise about pivot 82. As cradle 80 pivots clockwise, end 83 of upper toggle link 84 moves up and to the right with respect to FIG. 4 permitting coiled tension springs 86, connected between toggle knee 87 and manual operating handle 88 to collapse toggle 84, 85 and move handle 88 to the left. The latter is pivoted about center 89 through a connection between handle 88 and its rearward extension 91.

The lower end of lower toggle link 85 is pivotally connected at 92 to the free end of radial extension 93 of contact carrier 90. This causes carrier 90 to pivot clockwise with respect to FIG. 4 and by so doing moves the contact arms 31 of all three poles to the solid line or open circuit position of FIG. 2. It is noted that base 21 is a multipart unit having sections which mate along dividing line 23 so that the reduced diameter bearing portions of contact carrier 90 may be inserted and captured in operative positions. In the closed position of circuit breaker portion 59 an individual torsion spring 94, interposed between carrier 90 and movable contact arm 31, biases arm 31 counterclockwise about insulating rod 99 as a center and thereby generates contact pressure.

For each pole A, B, C an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contactor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet 111 (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extension 73. The latter is flexibly mounted to trip bar 75 at resilient reduced cross-section area 116 which is constructed to bias extension 73 forward.

As circuit breaker section 59 is opened and closed, movable contact arm 31 moves between the solid line and phantom positions illustrated in FIG. 2. In the solid line position of arm 31 movable contact 30 is separated from stationary contact 29. In this position indicating portion 175 at the end of contact arm 31 remote from movable contact 30 is viewable from the front of starter 20, as seen in FIG. 1. Indicating portion 175 is at the free end of contact arm section 176 that is located forward of contact arm pivot 99. Further as arm 31 is viewed in FIG. 2, indicating section 175 and movable contact 30 are on opposite sides of contact arm pivot 99.

As contact arm 31 pivots counterclockwise toward the closed circuit position indicated in phantom FIG. 2, indicating portion 175 moves to the left with respect to FIG. 2 through housing aperture 174, to a retracted position wherein neither indicating portion 175 nor other portions of contact arm 31 are viewable from outside of housing 21, 22. Thus, when indicating portion 175 is in its projecting or solid line position of FIG. 2, this is a positive indication that cooperating contacts 29, 30 and separated.

For more detailed descriptions of certain elements illustrated in the drawings reference is made to one or more of the following co-pending U.S. Patent applications Ser. Nos. 681,243, 681,245, 681,250, 681,244, all filed on even date herewith.

Although a preferred embodiment of this invention has been described, may variations and modifications will now be apparent to those skilled in the art, and it is therefore preferred that the instant invention be limited not by the specific disclosure herein but only by the appending claims.

The embodiments of the invention in which an exclusive privilege or property is claimed are defined as follows:

1. An electrical switching device including a housing, cooperating movable and stationary contacts within said housing, an elongated arm within said housing; said movable contact being mounted at one end of said arm; a pivot means near the other end of said arm mounting the latter for movement between a first and a second position wherein said contacts are opened and closed, respectively; said arm at a position remote from said one end including an indicating portion operatively positioned for direct viewing from positions in front of said housing, and without opening any portion of said housing, when said arm is in one of its said positions whereat said indicating portion projects through a side opening in said housing; with said arm in the other of its said positions said indicating portion being retracted from viewing from positions in front of said housing.

2. An electrical switching device as set forth in claim 1 in which said one of its said positions is said first position, wherein the contacts are opened.

3. An electrical switching device as set forth in claim 1 in which the pivot means is between the movable contact and the indicating portion, said movable contact being remote from said pivot means and said indicating portion being in the vicinity of the pivot means.

4. An electrical switching device as set forth in claim 3 in which the indicating portion is forward of the pivot means.

5. An electrical switching device as set forth in claim 3 in which the indicating portion moves forward as the arm moves from said first position to said second position.

6. An electrical switching device as set forth in claim 5 in which the indicating portion is forward of the pivot means.

7. An electrical switching device as set forth in claim 6 in which said one of its said positions is said first position, wherein the contacts are opened.

8. An electrical switching device as set forth in claim 1 in which the indicating portion is integral with said arm.

* * * * *